United States Patent [19]

Wittmann et al.

[11] Patent Number: 4,573,226

[45] Date of Patent: Mar. 4, 1986

[54] INSERT FOR A PIECE OF LOUNGING FURNITURE

[76] Inventors: Franz Wittmann, No. 205 Kellergasse; Karl Wittmann, No. 227 Kellergasse, both of A-3492 Etsdorf am Kamp, Austria

[21] Appl. No.: 570,894

[22] Filed: Jan. 16, 1984

[30] Foreign Application Priority Data

Feb. 2, 1983 [AT] Austria ..... 352/83

[51] Int. Cl.[4] ..... A47C 23/06

[52] U.S. Cl. ..... 5/236 R; 5/237; 5/238; 5/191

[58] Field of Search ..... 5/236 R, 236 B, 237, 5/238, 239, 241, 191

[56] References Cited

U.S. PATENT DOCUMENTS

| | | | |
|---|---|---|---|
| 29,679 | 8/1860 | Dennett | 5/191 |
| 4,136,411 | 1/1979 | Fanti | 5/238 |
| 4,222,134 | 9/1980 | Degen | 5/191 |

FOREIGN PATENT DOCUMENTS

| | | | |
|---|---|---|---|
| 0050293 | 4/1982 | European Pat. Off. | 5/236 R |
| 8201139 | 10/1983 | Netherlands | 5/191 |
| 461049 | 8/1968 | Switzerland | 5/237 |
| 600835 | 6/1978 | Switzerland | 5/191 |

*Primary Examiner*—Kenneth J. Dorner
*Assistant Examiner*—Michael F. Trettel
*Attorney, Agent, or Firm*—Frost & Jacobs

[57] ABSTRACT

An insert for a piece of lounging furniture comprising a frame and a plurality of resilient slats of different elastic properties spacially arranged for forming a slat grate, the slats being arranged in at least two superposed rows and staggered in relation to one another in a horizontal and in a vertical direction, wherein the slats of the upper row have greater elastic resilience than the slats of the lower row.

23 Claims, 26 Drawing Figures

XIII
XII
IX
A
L

Fig. 13
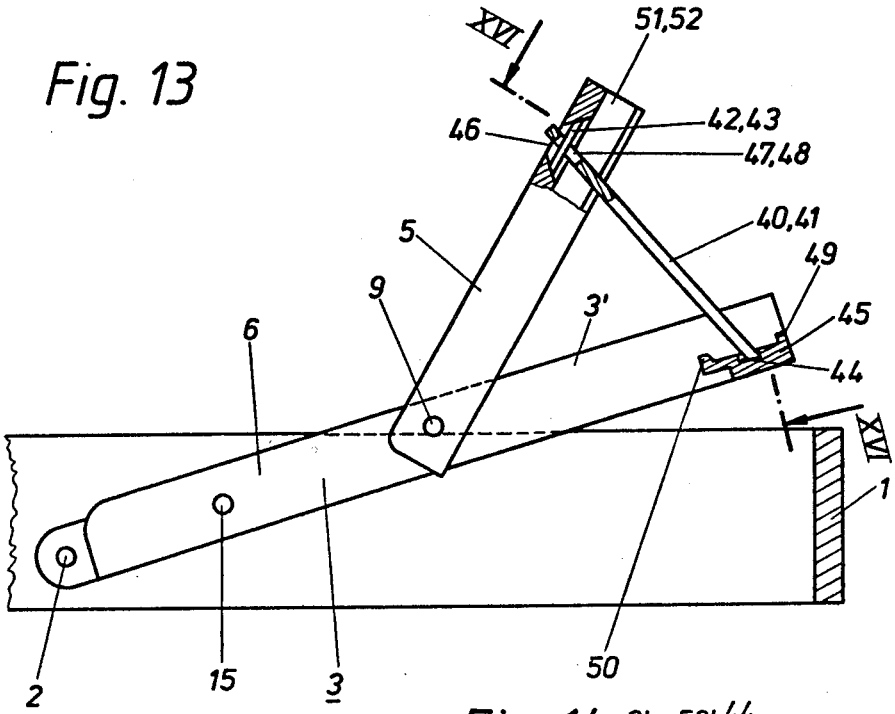
Fig. 14
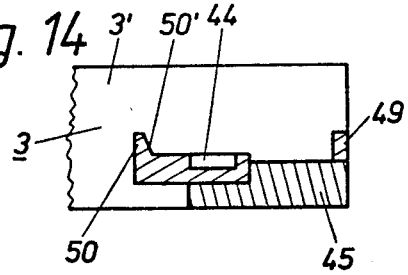
Fig. 16
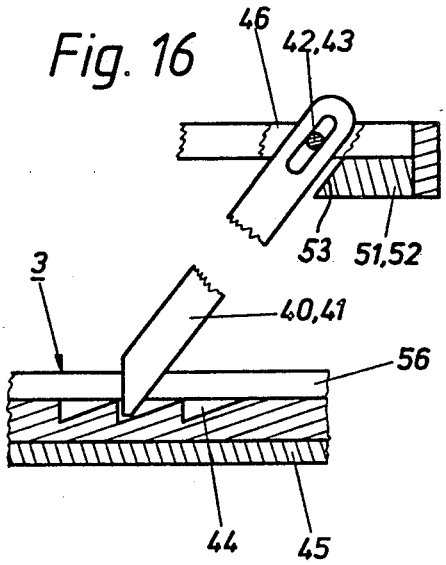
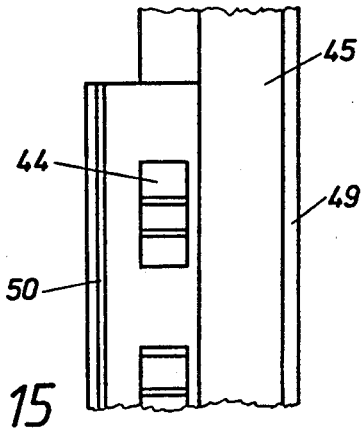
Fig. 15

Fig. 17
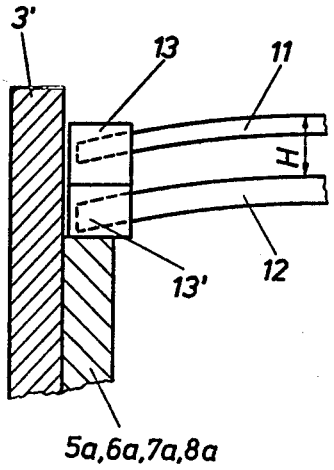
Fig. 18
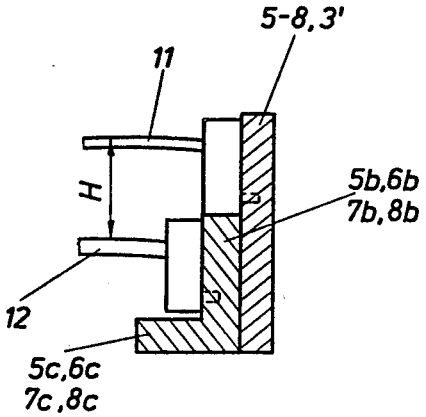
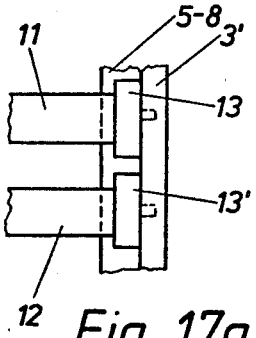
Fig. 17a
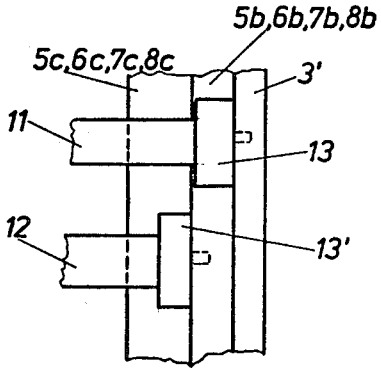
Fig. 18a
Fig. 23
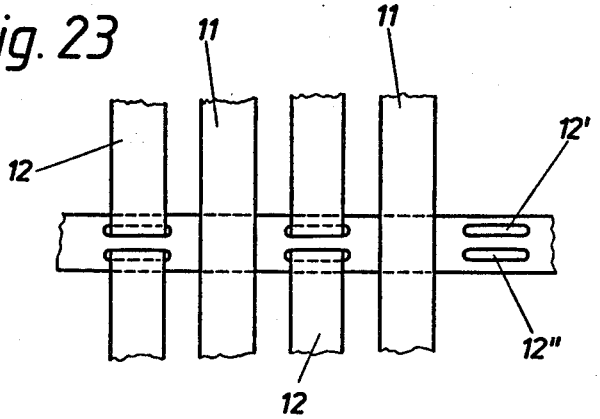

INSERT FOR A PIECE OF LOUNGING FURNITURE

The invention relates to an insert for a piece of lounging furniture, in particular a bed, comprising a frame and a plurality of resilient slats having different elastic properties.

In the known insert according to Austrian patent specification No. 360,197, the slats are formed as spring strips and arranged superposed in at least two rows and staggered in a horizontal direction. The arrangement is to assure an infinitely variable adjustment of the spring characteristics so that width, thickness and profile of the spring strips may differ.

In the insert according to AT-PS No. 360 197, however, the slats of the insert, at least in a horizontal direction, are not arranged spacially in relation to one another.

It is the object of the invention to provide an insert for a piece of lounging furniture whose spring suspension permits an optimal adjustment to the body weight of the user and an orthopedically correct support of the spinal column of the user.

This object is achieved in an insert of the type initially mentioned by arranging the slats spacially in relation to one another in a horizontal and in a vertical direction and by providing for the slats of the upper row to have greater elastic resilience than the slats of the lower row.

Depending upon body weight and part of the body, the slats of the upper row are first bent downward until the slats of the lower row become effective. This results in a spring force rising in proportion to the increasing load and assuring the desired optimal adjustment to the body weight and the body shape of the user and the orthopedically correct support of the spinal column.

In order to balance the spring suspension, it is of advantage to provide for the upward-curving slats of the upper row to be of lesser thickness, in particular of 7 mm, than the, preferably also upward-curving, slats of the lower row which are in particular 10 mm thick.

It is of advantage if the slats made of laminated wood, in particular beechwood laminate, of the lower row have thicker layers than the upper row, each slat having seven or eight layers of wood.

It is further of advantage for the slats of the upper row to have the same length as the slats of the lower row, altough the slats of an optionally provided head support are shorter than the slats in the remaining parts of the insert. The slats of the upper row could also be of greater length than the slats of the lower row. In this case, however, the inner walls of the inserts would have to be provided with ledge-shaped extensions.

It is possible to fasten the slats to the insert parts by means of loops, sleeves or the like made in particular of natural rubber, synthetic (plastic) materials, leather or textile materials enclosing the front ends thereof, with the loops, sleeves or the like being provided with preferably rearwardly closed pockets for receiving the ends of the slats, in particular with friction fit, a recess being provided underneath the pockets and the loops, sleeves or the like being provided in a manner known per se with a, preferably cylindrical, anchoring or bearing projection connected by means of a web and inserted in a bearing groove of an inwardly projecting ledge of the insert.

The invention is described in detail by means of an exemplary piece of lounging furniture according to the invention under reference to the accompanying drawings.

Figures 1, 2, 3, 4:
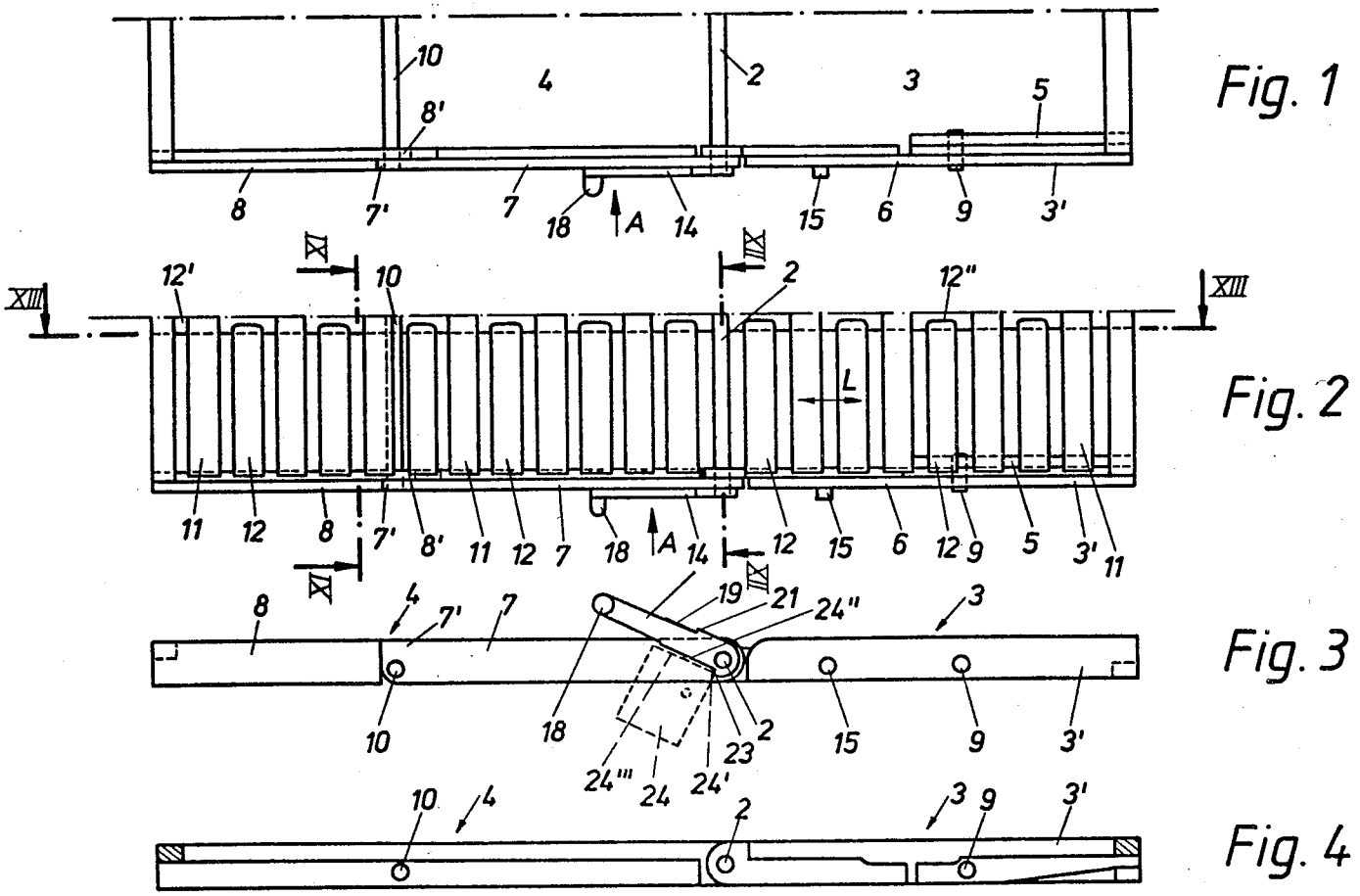
FIG. 1 shows a plan view of the frame and the insert parts of a piece of lounging furniture according to the invention at essentially plane position of the insert parts under omission of the slat grate.
FIG. 2 shows a view according to FIG. 1, but including the slat grate.
FIG. 3 is an elevational view of FIG. 1 or 2 in the direction of arrow A.
FIG. 4 is a view of FIG. 3 under omission of the walls of the frames of the insert parts facing the viewer.
Figure 10:
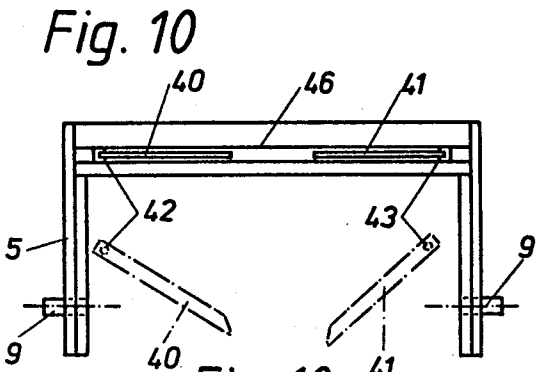
Figure 10A:
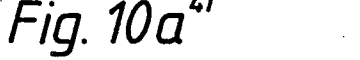
Figure 12:
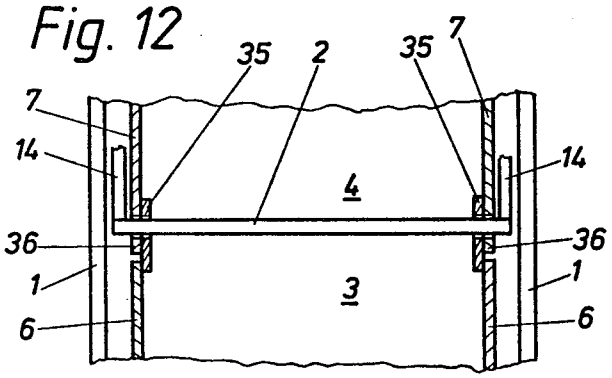
Figure 9:
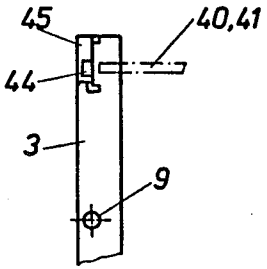
Figure 8:
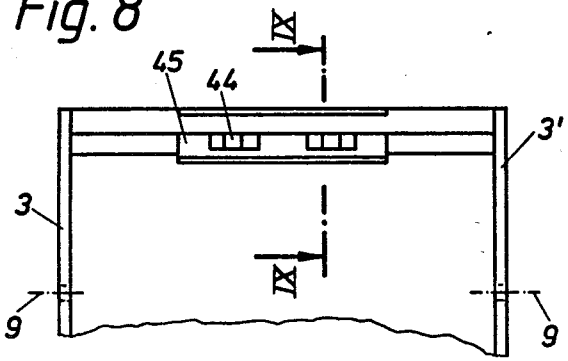
FIG. 8 is a top view of the head part.
Figure 8A:
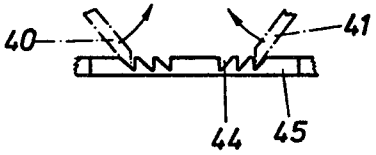
Figure 11:
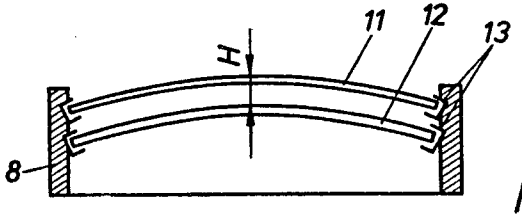
Figure 19:
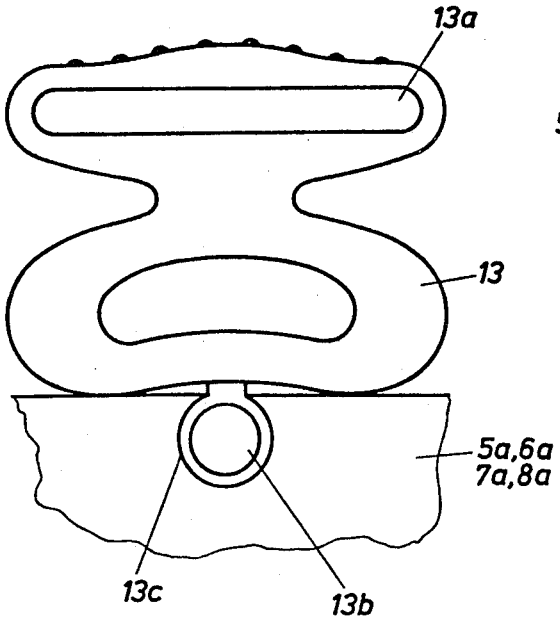

FIG. 8*a* is a partial interior view thereof;

FIG. 9 shows a sectional view along line IX—IX in FIG. 8;

FIG. 10 is a top view of the head part;

FIG. 10*a* is a partial view thereof;

FIG. 11 shows a sectional view along line XI—XI in FIG. 2;

FIG. 12 shows a sectional view along line XII—XII in FIG. 2;

FIG. 13 shows a preferred embodiment of the head support adjustment in sectional view along line XIII—XIII in FIG. 2;

FIG. 14 is a modified view along line XIII—XIII in FIG. 2 enlarged in comparison to FIG. 13;

FIG. 15 shows a top view thereof;

FIG. 16 is a representation of the head support mechanism slightly enlarged in comparison to FIG. 13 and shown along line XVI—XVI in FIG. 13 partly in sectional view;

FIGS. 17, 17*a* and in modified embodiment;

FIGS. 18, 18*a* show partial sectional views along line XI—XI in FIG. 2 enlarged as compared to FIG. 2, FIGS. 17 and 17*a* showing slats of equal length and FIGS. 18, 18*a* showing upper slats longer than the lower slats;

FIGS. 19 to 22 show the mountings or loops for such slats in perspective view and in central section, in the latter case including the support in the insert parts and FIG. 23 shows the supporting belt for the slats.

The piece of lounging furniture, in particular bed, as represented in the drawings comprises a furniture or bed frame 1 rectangular in top view and an insert consisting of two insert parts, namely a head part 3 and a leg part 4, articulated to one another by means of an axis of rotation 2. Each of the insert parts 3, 4 is also formed of two parts. The head part 3 consists of two articulated parts 5, 6, of which part 5, which is shown in FIGS. 1, 2, 5 and 13 on the right-hand side and within the flanges 3' of the head part 3, is called head support. The leg part 4 is also formed of two articulated parts, 7 and 8. Pins 9 serve as articulation axes for the head support 5 to the part 6 and a continuous axis 10 assures the articulated connection of parts 7, 8 of the leg part 4. For the articulated connection of the parts last mentioned, part 7 is provided with a projection 7' receiving the axis 10 on the outside of the frame 1 and part 8 is provided with a projection 8' receiving the axis 10 on the inside of the frame.

Each one of the insert parts 3, 4 (head part, leg part) and their individual parts 5, 6 and 7, 8 is provided with a rod or slat grate consisting of two spacially superposed rows of rods or slats extending transversely in relation to the longitudinal direction L of the insert. The slats 11, 12 of the two rows are staggered in relation to one another in a horizontal direction, so that in longitudinal direction L of the insert, one slat 11 of the upper row is succeeded by a slat 12 of the lower row, with a gap left in between, and so on. Only on either side of the axis of rotation 2, directly succeeding slats 12 are provided on the lower row. As shown in FIG. 11, the slats 11, 12 are advantageously curved upward, with the highest point of the curve positioned approximately in the central longitudinal plane of the piece of lounging furniture. The slats 11 of the upper row are of lesser thickness, for instance 7 mm, and thus of greater elastic resilience or yielding than the slats of the lower row which are about 10 mm thick. The slats 11, 12 consist of wood, in particular laminated wood or laminate, in particular beechwood laminate. Each one of the slats 11, 12 is made up of seven to eight layers, the layers of the slats 12 of the lower row being thicker than the slats 11 of the upper row. The distance between the slats 12 of the lower row and the slats 11 of the upper row in vertical direction bears the reference symbol H in FIGS. 11, 17 and 18. The mounting of slats 11, 12 on the insert parts 3, 4 and their individual parts 5,6,7,8 is effected by means of mountings, in particular sleeves or loops 13, 13' enclosing the ends of the slats 11, 12 and made of biologically compatible materials such as natural rubber, leather, textile materials or plastic materials.

As a result of the different elasticity or yielding properties of the slats 11, 12 of the upper and lower rows, the slats 11 of the upper row, depending upon the load, body weight and shape of the overlying body part, first bend downward until the slats 12 of the lower row become effective. This results in a spring force increasing in proportion to the load and permitting an optimal adjustment to the weight and shape of the body of the user.

Figure 20:
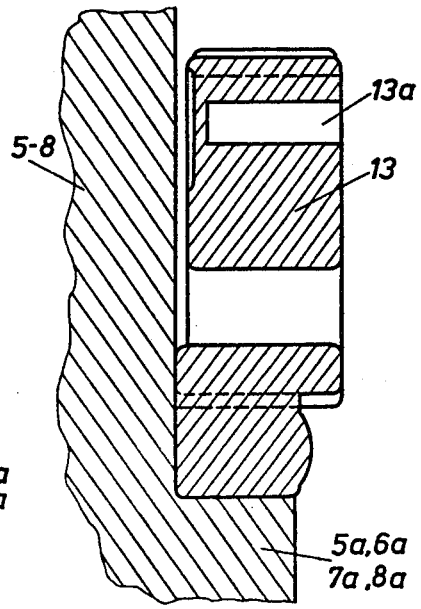
Figure 21:
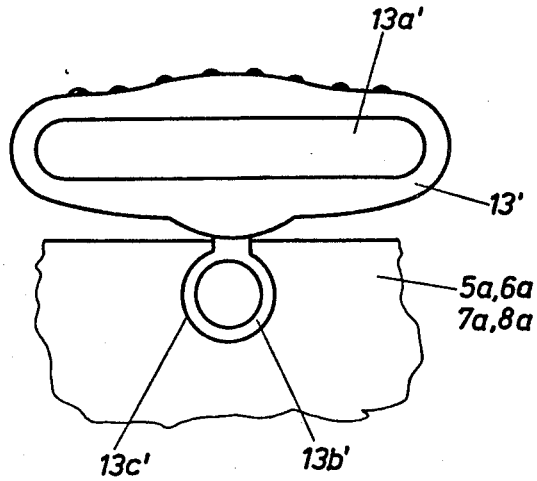
Figure 22:
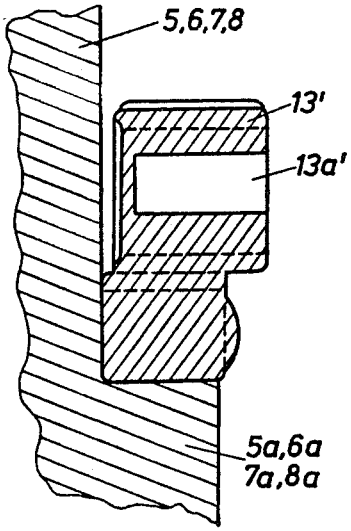

FIGS. 2, 11, 17, 17*a*, 18, 18*a* and 19 to 22 show various embodiments or arrangements of the slats or their fastening by means of loops 13, 13'. According to FIGS. 2, 11, 17, 17*a* and 19 to 22, the slats 11, 12 of the upper and the lower rows are of equal length in the head support and in the remaining part of the insert. This means that the mounting loops 13, 13' for the upper and lower slats 11, 12 are disposed on an aligned inner wall of the insert frame 6 to 9, but each shifted in the longitudinal axis of the bed. This also applies to the head support 5. Pockets 13*a* and 13*a*' for the loops 13, 13' are of different height corresponding to the thickness of the slats 11, 12. Moreover, the pockets 13*a*, 13*a*' have to be disposed at corresponding different levels in order to achieve the differing height position of the slats 11, 12. For this reason, the bodies of the loops 13, 13' are of different shapes, as shown in FIGS. 19 to 22. The loops 13, 13' are provided with fastening extensions 13*b*, 13*b*' by means of which they are inserted into correspondingly shaped slots 13*c*, 13*c*' of inwardly projecting ledges 5*a* to 8*a* of the inserts 5 to 8 and fastened there. FIGS. 20 and 22 each show perpendicular central sections of FIGS. 18 and 21 in the fastening zone. FIGS. 17 and 17*a* are scaled-down, partly elevational and partly top views of the situation in the fastening zone of the slats.

FIGS. 18 and 18*a* show the possibility to provide slats 11 of the upper row of greater length than the slats 12 of the lower row. In this case, the inserts 5 to 8 must be supported twice (at 5*b*, 5*c* to 8*b*, 8*c*). The loops 13' are advantageously shaped similar to the lower loops of the embodiment previously described (FIGS. 2, 11, 17, 17*a*).

The slats 11, 12 in the two embodiments are preferably of essentially rectangular cross section, but may have any given other cross section.

According to FIGS. 2 to 23, a belt 12' with slots 12" through which the slats are passed is advantageously provided in the zone of the central axis of the bed insert parts 3 to 5 for securing the lower slats 12.

For adjustment of the insert parts 3,4 to the desired positions, (FIGS. 3, 5 to 7), the essentially horizontal axis of rotation is rotatably supported in the insert parts 3,4 only and freely movable otherwise. The axis of rotation 2 is fixedly connected to an adjusting lever 14 at one of its axial ends or at both axial bends (c.f. in particular FIGS. 1 to 3, 5 to 7 and 12). The adjusting lever 14 is arranged freely movable in the gap between frame 1 and insert parts 3,4 and protrudes upward beyond the upper edge of the frame 1 and the insert parts 3,4 (at least in their horizontal position, FIGS. 3,7).

At a distance from the axis of rotation 2 or the adjusting lever 14, the head part is pivotally supported by means of pivot pins 15 on either side in frame 1. The pivot pins are also disposed essentially horizontally and extend parallel in relation to the axis of rotation 2. The leg part 4 is not secured in the frame 1, but freely adjustable or pivotable in relation thereto. The pivot pins 15 are guided in slot-shaped guides 16 or plates 17 secured to the inner side of frame 1.

The adjusting lever 14 is provided on its end facing away from the axis of rotation 2 with a handgrip 18 protruding laterally outward and has a rolling or sliding surface 19 on its side facing the pin 15, with the surface 19 formed to abut a rolling or sliding surface 20 formed on the plate 17 in the shape of a curve or round. In extension of the surface 19 of the lever 14, a projection 21 or a depression cooperating with one or two stop projections 22 on the plate 17 is provided on the lever 14 closer to the axis of rotation 2.

Figures 5, 6, 7:
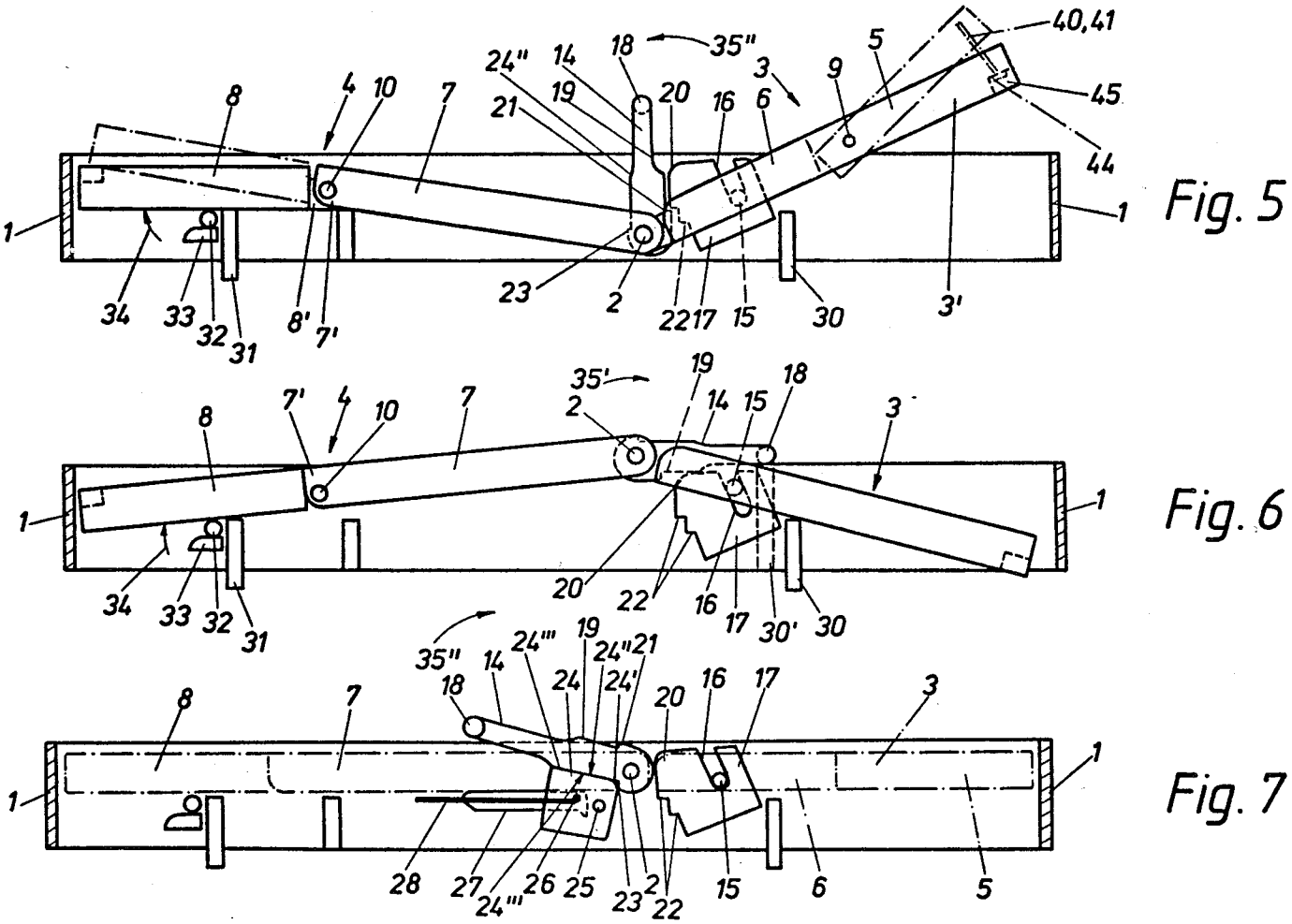
FIG. 5 shows the insert parts of the piece of lounging furniture according to FIGS. 1 to 4 in an upright reclining position.
FIG. 6 shows the insert parts of the piece of lounging furniture according to FIGS. 1 to 4 at prone or bridge position.
FIG. 7 is a view of the inside of the frame under omission of the insert parts.

On its (their) side(s) facing away from the pin 15, the adjusting lever(s) 14 is (are) provided in the zone of the axis of rotation 2 with a stop projection or nose 23 cooperating with an edge 23' of each one further plate 24 disposed on both sides of frame 1. The plate 24 is pivotably supported in relation to frame 1 around a pin 25 and has a pin-shaped stop 26 abutted by a wooden spring 28 provided in a slot 27 of the frame 1 and clamped spacially from the pin 25 of the plate 24. The wooden spring 28 tends to press the plate 24 upward around its pin 25. The upper edge of the plate 24 extends inclined in relation to the upper side of frame 1 even when the lever 14 rests on it (FIGS. 3 and 7). The adjusting lever 14 is provided on its side opposite the surface 19 with a supporting surface 24" cooperating with a supporting surface 24'" of the plate 24 pivotably supported on frame 1. The pins 15 rest on the bottom of the guides 16 without any contact being established between the adjusting lever 14 and the plates 17 bearing the guides 16 whenever the supporting surfaces 24", 24'" of the adjusting lever 14 and the plate 24 engage in the plane position of the insert parts 3,4.

When the adjusting lever(s) is (are) pivoted upward, the nose 23, by engaging the rounded-off edge 24' of the plate 24, slightly pivots or turns plate 24 counter-clockwise as shown in FIGS. 3 and 7, so that the lever 14 and thus the axis of rotation 2 is free to be lowered and the plane prostrate position can be changed to an upright reclining (FIG. 5) or prone or bridge position (FIG. 6).

At essentially plane position of the insert parts 3,4, as shown in FIGS. 3 and 7, the adjusting lever 14 projects slightly obliquely upward.

An abutment 30 extending across frame 1 is provided for supporting the head part 3 also extending across frame 1. An abutment 31 is provided as a support for the leg part 4. A stop 33 pivotable in the direction of arrow 34 around an essentially horizontal axis 32 is provided on the abutment 31 for raising the legs. (FIGS. 6, 7).

If the piece of lounging furniture is to be brought into an upright reclining position, as shown in FIG. 5, the adjusting lever 14 is pivoted toward the head side under loading the insert parts 3, 4, whereby the plate 24 is slightly turned, as described above. This makes the axis of rotation 2 (which, as shown in FIG. 12, is freely rotatable in bearings 35, 36 of the insert parts 3, 4) free for a downward movement and the head part 3, due to the body weight of the user, pivots around pin 15 resting on the lower end of the slot guide 16 to an inclined position in relation to frame 1. The leg part 4 is moved to an inclined position at the same time. The final position is shown in FIG. 5. If the legs are to be raised, the pivotable stop 33 is pivoted in the direction of the arrow 34 until the part 8 of the insert part 4 reaches the position shown in dash-dotted lines in FIG. 5. The upright reclining position is secured when the projection 21 or the depression of the adjusting lever 14 engages behind a stop projection 22 of plate 17.

If the piece of lounging furniture is to be brought into the prone or bridge position shown in FIG. 6, the adjusting lever 14 is pivoted according to arrow 35' in FIG. 6. The adjusting lever 14 moves with its surface 19 along the surface 20 on the plate 17 fixed to frame 1. The pin 15 now moves upward in its guide 16 and the axis of rotation 2 is lifted up. As a result of this movement, the head part and the leg part now incline downward from the axis of rotation 2. The head part now abuts the abutment 30 and the leg part abuts the abutment 31. In this position, the adjusting lever 14 and thus the bridge position can be secured by sliding a loop 30' (FIG. 6) or pivoting a hook lever over the hand grip 18 of the adjusting lever 14.

In the previously mentioned, substantially plane position of the insert parts 3,4 as shown in FIG. 3, the stop projection 23 of the adjusting lever 14 engages behind the corner or edge 24' of plate 24 and rests with the supporting surface 24'' on the inclined supporting surface 24''' of the plate 24. As a result, the pin 15 is supported on the bottom of slot 16 and the horizontal position of parts 3, 4 is secured without any additional measures although no contact between lever 14 and plate 17 is established in this case. In changing to the upright reclining position, the adjusting lever 14 is pivoted in the direction of arrow 35'' towards the head end, whereby the stop projection 23 raises the plate 24 and the axis of rotation 2 becomes free to move downward and permits the inclined position of the insert parts in relation to one another as previously described.

The adjustability of the head support 5 is shown in detail in FIGS. 8 to 10 as well as 8*a*, 10*a* and 13 to 16 and is described in detail in the following under reference to these representations. The head support is provided with two pivotably supported supporting arms 40, 41. Each one of the arms 40, 41 is pivotably supported on one end around a pivot pin 42, 43 provided on the upper end of the head support 5, while its other free end is insertable into a strip 45 provided with stops 44 and fixed to the frame 3' of head part 3. The pivot pins 42, 43 are arranged spacially in relation to one another, viewed from the head end, one of them is provided close to the right-hand upper corner and the other one close to the left-hand upper corner of the head support 5. The axes of pivot pins 42, 43 extend essentially transversely to the axis of rotation 2 and the arms 40, 41 are insertable into a slot 46 of the head support 5, so that the arms 40, 41 are pivotable in a plane extending essentially vertically in relation to the plane of the head support 5. The strip 45 with the stops 44 is arranged essentially parallel in relation to the axis of rotation 2. The free ends of arms 40, 41 can be rounded off for easier engagement with the stops 44 of strip 45. FIGS. 8 and 10 shows the arms 40, 41 at raised head support in their position pivoted out of slot 46 in dash-dotted lines.

As evident from FIGS. 13 to 16, the head support 5, particularly on its top side, is provided with a slot-shaped recess 46 for receiving and supporting the arms 40, 41. Recess 46 widens downward, the thickness of the upper and outer supporting arm ends decreases upward and outward. Arms 40, 41 are provided with elongated holes 47, 48 extending in their longitudinal direction and movably supporting the arms 40, 41 on and around pivot pins 43, 43 provided in the head support 5. The pivot pins 42, 43 are arranged essentially transversely in relation to the axis of rotation 2 of the insert parts 3,4, so that the arms 40, 41 are pivotably oscillating in a plane deviating from the plane of the head support 5. As particularly evident from FIGS. 14 and 15, the strip 45 provided with stops 44 has one each upwardly projecting ledge 49,50 for guiding the supporting arms 40, 41 on the outside as well as the inside of the bed. The ledge provided on the inside of the bed has an outward facing surface 50' fased upward so that its cross section tapers upward and facilitates the insertion of the supporting arms 40, 41 in their inactive position in the slot-shaped recess 46. The head support 5 is provided with stops 51, 52 for limiting the outward movement of the supporting arms 40, 41; these stops are positioned on the outer ends of the slot-shaped recess next to, outside and underneath of the pivot pins 42, 43. These limiting stops 51, 52 are provided with inclined surfaces 53 facing downward and inward. The supporting arms must be movable on their pivot pins so as to allow their insertion into all of the associated stops for various raised positions of the head support. This calls for the elongated holes 47, 48 as well as for the inclined surfaces on the recess 46. The surfaces 51, 52 serving as stops for the arms 40, 41 prevent an excessive outward pivoting of the arms so that an easy lowering of the head support to its inactive position is possible at all times.

The piece of lounging furniture described above can be made of wood in all its components so that it will meet all biological requirements.

We claim:

1. An insert for a piece of lounging furniture having a frame comprising longitudinal parts and slats, the slats being arranged transversely in relation to the longitudinal parts and spatially measured in a horizontal direction for forming a slat grate extending over an entire reclining surface, said slats being connected to said longitudinal parts and being arranged in at least two superposed rows vertically spaced from one another with the slats of superposed rows being staggered in relation to one another in horizontal and vertical direction in such manner that in plan view the slats of the different superposed rows are also disposed spatially apart in a horizontal direction, with all the slats being resilient and the slats of each upper row having greater resilience than the slats of each lower row, said longitudinal parts being provided with bearings of elastic material in which the ends of the slats are supported, with the ends of the slats of the various rows also being spaced from one another measured in vertical direction within the range of the supporting bearing.

2. The insert according to claim 1, wherein the slats are releasably supported in said bearings of elastic material.

3. The insert according to claim 2, wherein the bearings of elastic material are pockets open toward the interior of the insert into which the ends of the slats are inserted.

4. The insert according to claim 3, wherein loops of elastic material are attached to said longitudinal parts provided with said pockets for receiving the ends of the slats, and a recess is provided in the loops underneath the pockets, said loops have an anchoring projection connected with a web, and the longitudinal parts of the insert are provided with supporting grooves into which said anchoring projections are inserted.

5. The insert according to claim 4, wherein said longitudinal parts are provided with inwardly projecting ledges in which said supporting grooves are provided.

6. The insert according to claim 4, wherein said loops are made of natural rubber.

7. The insert according to claim 4, wherein the pockets are closed at the back sides thereof.

8. The insert according to claim 1, wherein the slats of each upper row are of lesser thickness than the slats of each lower row.

9. The insert according to claim 1, wherein the slats are made of laminated wood and the slats of the lower row have thicker layers than the slats of the upper row.

10. The insert according to claim 9, wherein said laminated wood is beechwood laminate.

11. The insert according to claim 1, wherein at least the slats of the upper row are curved upward.

12. The insert according to claim 1, wherein the slats of the upper row are of the same length as the slats of the lower row.

13. The insert according to claim 1, wherein the slats of the upper row are of greater length than the slats of the lower row.

14. An insert for a bed having a frame comprising longitudinal parts and slats, the slats being arranged transversely in relation to the longitudinal parts and spatially measured in a horizontal direction for forming a slat grate extending over an entire reclining surface, said slats being connected to said longitudinal parts and being arranged in at least two superposed rows vertically spaced from one another with the slats of superposed rows being staggered in relation to one another in horizontal and vertical direction in such manner that in plan view the slats of the different superposed rows are also disposed spatially apart in a horizontal direction, with all the slats being resilient and the slats of each upper row having greater resilience than the slats of each lower row, said longitudinal parts being provided with bearings of elastic material in which the ends of the slats are supported, with the ends of the slats of the various rows also being spaced from one another measured in vertical direction within the range of the supporting bearing.

15. The insert according to claim 14, wherein the slats are releasably supported in said bearings of elastic material.

16. The insert according to claim 15, wherein the bearings of elastic material are pockets open toward the interior of the insert into which the ends of the slats are inserted.

17. The insert according to claim 14, wherein at least the slats of the upper row are curved upward.

18. The insert according to claim 14, wherein the slats of the upper row are of greater length than the slats of the lower row.

19. The insert according to claim 14, wherein said frame, said longitudinal parts and said slats are made of wood.

20. The iinsert according to claim 19, wherein the slats are releasably supported in said bearings of elastic material.

21. The insert according to claim 20, wherein the bearings of elastic material are pockets open toward the interior of the insert into which the ends of the slats are inserted.

22. The insert according to claim 19, wherein at least the slats of the upper row are curved upward.

23. The insert according to claim 19, wherein the slats of the upper row are of greater length than the slats of the lower row.

* * * * *